United States Patent [19]

Aiello

[11] Patent Number: 4,835,520

[45] Date of Patent: May 30, 1989

[54] TALKING ALARM FOR OPENABLE COMPARTMENT

[76] Inventor: Thomas Aiello, 14561 Eastpoint, Sterling Heights, Mich. 48078

[21] Appl. No.: 41,999

[22] Filed: Apr. 24, 1987

[51] Int. Cl.[4] ..... G08B 13/08

[52] U.S. Cl. ..... 340/545; 368/10; 340/522; 340/309.15; 200/61.62; 116/100; 62/131

[58] Field of Search ..... 340/545, 692, 309.15, 340/522; 368/10; 221/3; 177/143; 312/236; 364/479; 219/10.55 C; 200/61.62, 61.64, 61.69, 61.44; 116/12, 85, 86, 100; 70/267–271; 109/44, 43; 62/125, 131, 531

[56] References Cited

U.S. PATENT DOCUMENTS

| | | | |
|---|---|---|---|
| 3,866,173 | 2/1975 | Moorman et al. | 340/568 |
| 3,938,120 | 2/1976 | O'Connell | 200/61.69 |
| 4,024,494 | 5/1977 | Quesnel | 200/61.44 |
| 4,117,461 | 9/1978 | Kiebala | 340/545 |
| 4,463,348 | 7/1984 | Sidebottom | 62/125 |
| 4,588,303 | 5/1986 | Wirtschafter et al. | 368/10 |
| 4,679,031 | 7/1987 | Hwang | 70/267 |
| 4,682,299 | 7/1987 | McIntosh et al. | 340/309.15 X |
| 4,691,195 | 9/1987 | Sigelman et al. | 340/545 |

*Primary Examiner*—Joseph A. Orsino
*Assistant Examiner*—Jill D. Jackson
*Attorney, Agent, or Firm*—Krass & Young

[57] ABSTRACT

A message-generating apparatus for discouraging access to a compartment during predesignated time intervals. The apparatus includes a detector to determine when the compartment door is open and to produce a signal when this event occurs. If the event occurs within a predesignated alarm time interval, a microprocessor produces a reminder signal which activates a speech synthesizer to produce a voice-like audible message. Also disclosed is a display to aid in designating time-of-day, messages, and alarm time intervals.

4 Claims, 3 Drawing Sheets

TALKING ALARM FOR OPENABLE COMPARTMENT

FIELD OF THE INVENTION

This invention relates to refrigerator alarms, and more particularly to refrigerator alarms which generate voice-like audible messages whenever the refrigerator is opened within a predesignated alarm time interval.

BACKGROUND OF THE INVENTION

Many people in the United States, and around the world, are currently interested in reducing the amount of food they eat each day. One form of eating behavior exhibited by many of these people, between-meal eating, is particularly difficult to control. Suppression of between-meal eating is made all the more difficult by ready access to food, especially food which requires little or no preparation and is kept in refrigerators or cupboards.

While it is possible to lock or otherwise reduce the convenience of the accessibility of food to decrease between-meal eating, such approaches are unnecessarily burdensome on those members of a household who are not attempting to reduce food intake or who might keep hours other than those kept by the person attempting to reduce food intake.

It is desirable, therefore, to have an apparatus which can provide sufficient psychological discouragement to a person wishing to reduce food intake while not unduly inconveniencing other members of a household or denying the person access to food at usual eating hours.

SUMMARY OF THE INVENTION

The present invention solves the problem of producing a psychologically reinforcing refrigerator alarm which provided minimal disruption to other members of a household.

In general, this is accomplished by attaching a sensor to the refrigerator door for sensing when the door is opened and a clock for determining whether the door is being opened during non-mealtime hours. In case it is the apparatus issues a voice-like discouraging warning message and sets a "door open" visual indicator.

According to the preferred embodiment, the message-generating apparatus is for use in connection with a compartment having an access opening and a closure for the opening. It comprises a detector which produces a signal when the compartment closure is moved toward a position which allows access to the compartment and a clock which produces an enabling signal when the time of day falls within a predetermined time interval. When the detector and clock simultaneously produce signals, a microprocessor produces a reminder signal which actuates a voice synthesizer to produce the desired discouraging message. The detector can comprise either a motion detector or a door switch. The message generating apparatus can also comprise a display to be used for programming the time-of-day, the messages to be delivered, and the alarm time intervals.

DETAILED DESCRIPTION OF THE PREFERRED EMBODIMENT

Figure 1:
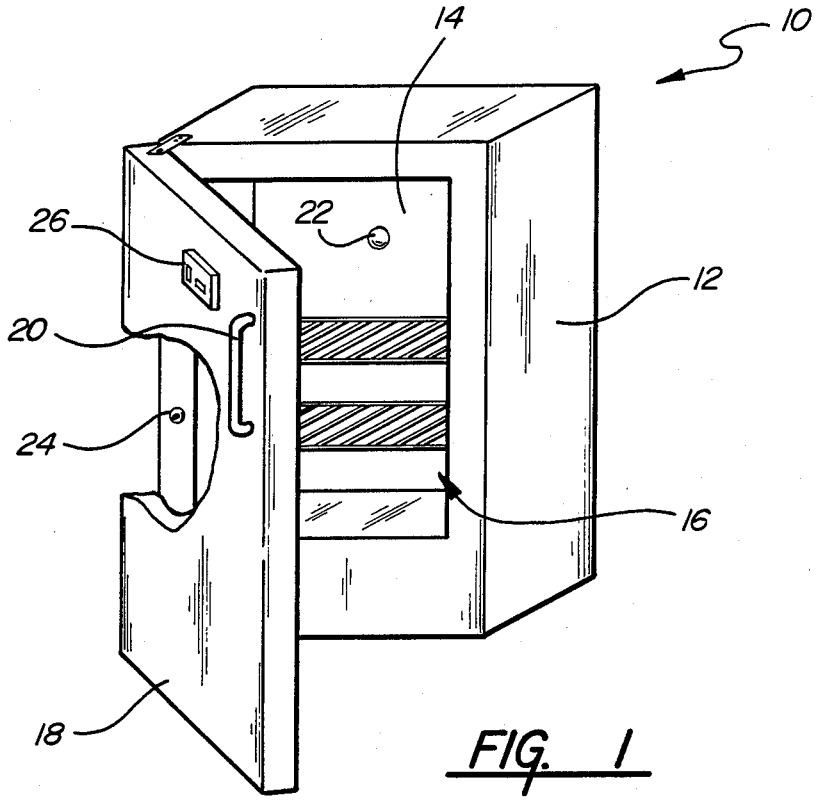
FIG. 1 is a cut-away view of a refrigerator showing the use of the apparatus of the invention.

Referring now to the figures of the drawings, one will readily appreciate the preferred embodiment of the apparatus of the invention. Referring specifically to FIG. 1, a refrigerator 10 having a body 12 with an internal volume 14 accessible through an access opening 16 also includes a closure 18 such as a door. Closure 18 can be moved from a closed position in which it covers opening 16 to an open position in which access to volume 14 is gained, by taking appropriate action, such as pulling on handle 20. Closure 18 may also be moved from the opened position to the closed position by operating handle 20.

When compartment 10 is a refrigerator, as illustrated in FIG. 1, a light 22 (such as an electric lamp) is typically turned on when closure 18 is opened to illuminate the interior volume 14. The condition of the door being opened is commonly detected through a jamb switch 24 which is usually biased closed by a spring but held open when closure 18 is in the closed position.

Figure 2:
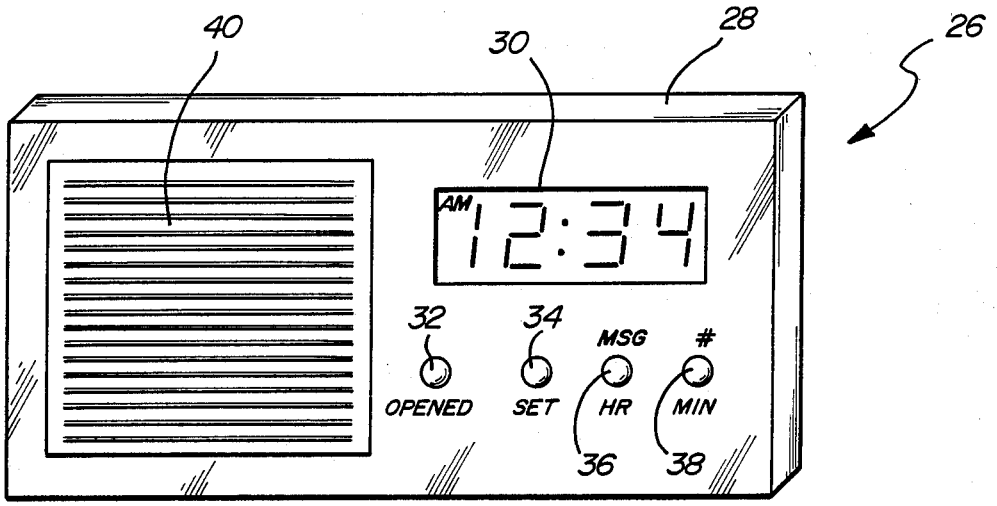
FIG. 2 is a close-up view of one embodiment of the apparatus of the invention.

Attached to closure 18 is message-generating apparatus 26, shown in closer detail in FIG. 2. Apparatus 26 includes a housing 28 in which is mounted a display 30, such as a liquid crystal display (LCD) or a light-emitting diode (LED) display. Housing 28 also contains warning light 32 (which may be any light-emitting device such as an LED) and operating switches 34, 36, and 38, whose function will be described later in this detailed description. Housing 28 also contains a speaker grill 40 intended to protect the speaker which is placed behind it.

Through electronic circuitry to be described in greater detail in the following, message-generating apparatus 26 detects when the closure 18 of compartment 0 has been moved toward a position which allows access to the interior volume 14 of the compartment. If this event occurs within a predesignated time interval, message-generating apparatus 26 will emit a voice-like audible message to remind the person opening the closure that they are, in fact, opening the closure. The message-generating apparatus 26 of the invention therefore has utility in discouraging persons from accessing a refrigerator outside of predesignated mealtime hours. The message is delivered with a voice-like quality, thereby increasing its impact on the person opening the compartment. Other uses of the message-generating apparatus are to monitor other unlocked food-containing compartments or to monitor the unlocked door of a room is which a child who is trying to fall asleep may be found.

Figure 3:
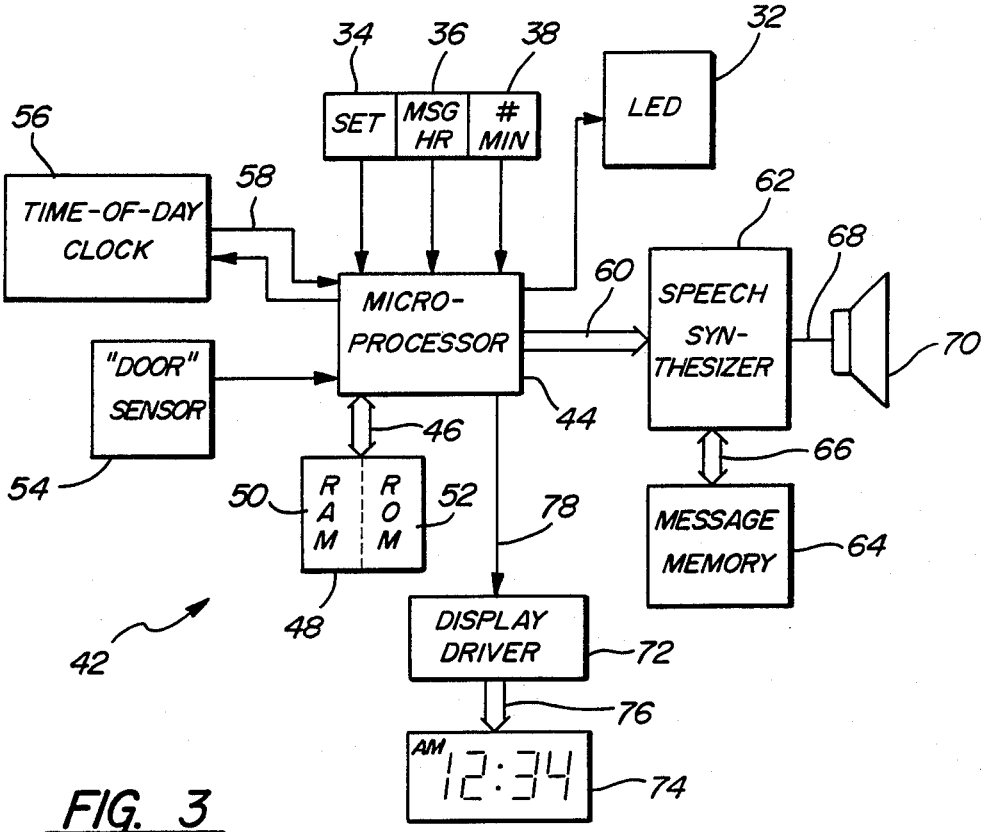
FIG. 3 is a block diagram of the electronic components of the apparatus of the invention.

Referring now to FIG. 3 of the drawings, one skilled in the art will appreciate that the electronic components 42 contained within housing 26 include a microprocessor 44 which communicates over a bi-directional bus 46 with a memory 48 comprising a random access memory (RAM) 50 and a read-only memory (ROM) 52. When electrical power is first applied to microprocessor 44, a program contained within ROM 52 is loaded into RAM 50 for execution. The instructions constituting the program controlling microprocessor 44 are transmitted over bus 46 to appropriate instruction registers contained within microprocessor 44 prior to execution.

Microprocessor 44 also receives signals from sensor 54 which detects that closure 18 has been opened. Sensor 54 can, therefore, be a motion-detecting sensor of the sort commonly known to those skilled in the art or a switch, such as the door jamb switch 24 in FIG. 1. In addition, microprocessor 44 receives enabling signals from clock 56 over line 58 when the current time of day falls within user-designated time intervals during which it is intended that the message-generating apparatus be activated. Alternatively, the times defining the start and stop times of the alarm intervals can be stored in RAM 50 of memory 48. In this alternative arrangement, the time-of-day signal is sent by clock 56 over line 58 is continually compared to the time intervals stored in RAM 50. If the time of day falls within an alarm time interval, microprocessor 44 assumes an enabling condition, in which it is enabled to cause a message to be generated when the closure is opened.

When microprocessor 44 senses that the closure has been opened and the time of day is within a predetermined alarm period, an appropriate signal is transmitted over bus 60 to speech synthesizer 62. In addition to the speech synthesizer activation signals which are sent over bus 60, microprocessor 44 will designate a message to be spoken. Numerical designations of messages to be spoken are stored in RAM 50 of memory 48 and transmitted to speech synthesizer 62, which in turn accesses its own message memory 64 over bus 66. The data required by speech synthesizer 62 in order to deliver the chosen message are returned by message memory 64 to speech synthesizer 62 which, in turn, produces an audio signal on line 68, connected to speaker 70. Speaker 70 is placed behind enclosure 40 of FIG. 2.

Messages to be delivered can be associated with certain preselected time intervals, thus tailoring the message generated to be appropriate to the time of day. Alternatively, microprocessor 44 can randomly generate a recognizable message number which it then delivers to speech synthesizer 62 to initiate playback of the chosen message.

Microprocessor 44 also causes display driver 72 to send signals to display 74 over bus 76. The signals are sent over line 78 and represent the times sent to microprocessor 44 by clock 56.

Microprocessor 44 also receives signals from buttons 34–38. These signals are used by microprocessor 44 to program clock 56, alarm time intervals, and (possibly associated) message numbers. Set button 34 controls the information displayed on display 74 and the programming mode into which microprocessor 44 is set. Microprocessor 44 may possibly display or set data when in any of four distinct programming modes: time-of-day message, starting time, and stopping time. Microprocessor 44 cycles among these four conditions, depending on the number of times set button 34 is activated.

The four display/set modes and the use of buttons 34–38 are illustrated in FIG. 4 of the drawings. In FIG. 4*a*, display 74, which includes a digital means for displaying numeric data including times and message numbers, is showing the time 12:34 am. This time may be changed by appropriately activating "HR" button 36 or "MIN" button 38. These buttons respectively cause times shown on display 74 to be incremented. Thus, to reset the time of day, set button 34 is activated until display 74 is placed in time-of-day mode and hour and minute buttons 36 and 38, respectively, are activated until the correct time-of-day is shown on display 74.

Figure 4A:
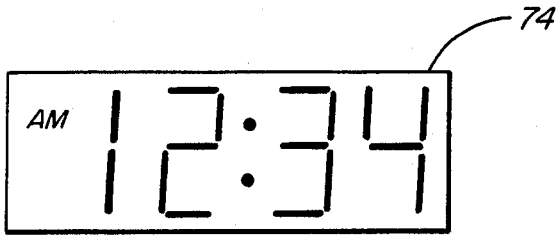
FIG. 4*a*–4*d* shows four views of the display of the apparatus of the invention.
Figure 4C:
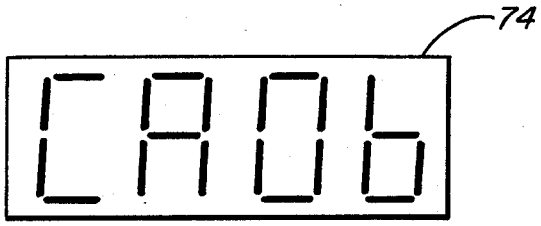
Figure 4B:
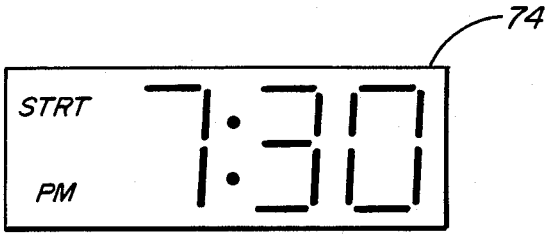

Set button 34 may be used to place display 74 in "starting time" programming mode shown in FIG. 4*b*. In this mode, button 36 controls the hour designation, while button 38 controls the minutes designation. The user can easily see that display 74 is in the "start time" mode because the display shows a special symbol ("STRT").

As shown in FIG. 4*c*, set button 34 has been activated to put display 74 in messages programming mode. This mode is designated on display 74 by a special symbol, such as the "C" (representing the word "code") is shown in the leftmost digit of display 74. When in this mode, button 36 designates a "message"digit, the second digit of display 74, written as an alphabetical character, while button 38 designates message "numbers." By reference to a manual supplied with the apparatus, the user can code any of a variety of available messages. Any of the messages designated now will be assocaited with the alarm time interval whose start time has just previously been set and whose stop time is about to be programmed.

Figure 4D:
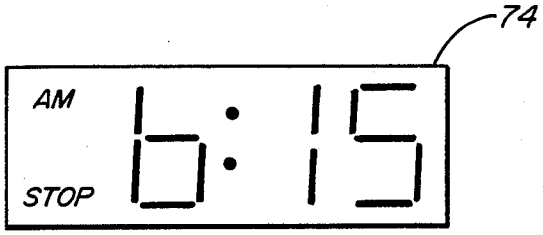

The stop time can also be designated by placing display 74 in the stop time programming mode, shown in FIG. 4*d*, by actuating set button 34. As before, buttons 36 and 38 respectively designate hours and minutes of the stop time. The fact that the display is in stop time mode is designated by the special indicia ("STOP").

In addition to the operations designated above, microprocessor 44 can also activate LED 32 when sensor 54 is activated while clock 56 is producing an enabling signal. LED 32 can be reset by simultaneously depressing buttons 36 and 38.

Although in most applications it will be preferable to have a sensor 54 which operates as a motion detector, in some applications, for example, if the apparatus of the invention is built into an appliance such as a refrigerator, the apparatus can be activated through the opening of the door jamb switch. Such a switch is shown as 24 in FIG. 1. If the apparatus is built into an appliance, the required electrical energy can be supplied through the wiring of the appliance itself. However, if the apparatus is not built in, electrical power will be supplied by a conventional battery, such as a 9-volt transistor radio battery.

Figure 5:
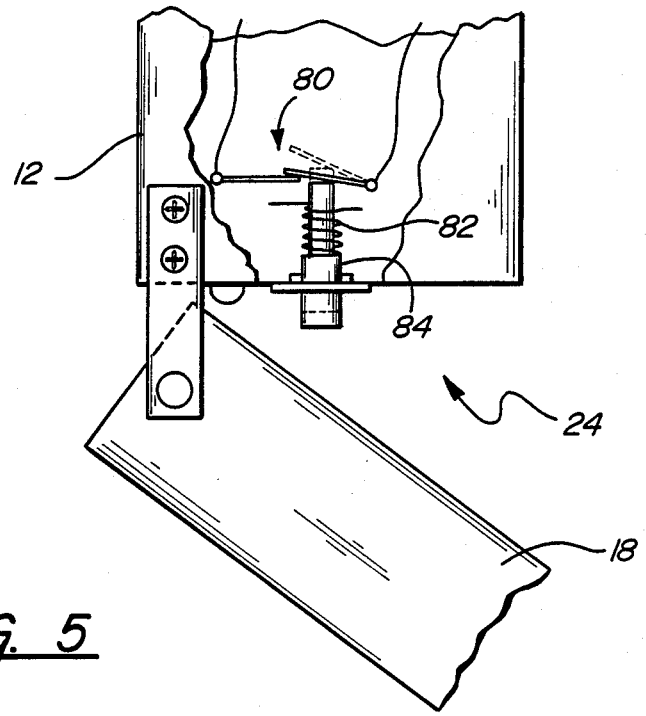
FIG. 5 is a cut-away view of the door jam switch of the refrigerator of FIG. 1.

FIG. 5 of the drawings illustrates a door jamb switch of the type which can be used with the apparatus of the invention when it is built into an appliance. Switch 24 comprises a pair of contacts 80 which are normally biased into contact by a spring 82 operating on a plunger 84. However, when closure 18 is closed, the plunger 84 of switch 24 is forced to work against spring 82, thereby opening contact 80. It will be easily appreciated by those skilled in the art that switch 24 can be used as sensor 54 of FIG. 3.

While the preceding is a detailed description of one preferred embodiment of the apparatus, it will readily appreciated by those skilled in the art in which this invention pertains that a number of modifications within the spirit and scope of the invention are possible. By way of illustration the speech synthesizer can be replaced b a tape player which has a series of appropriately recorded messages, the tape player being operated by the microprocessor means. Therefore, the spirit and scope of the invention are to be limited only by the following claims.

I claim:

1. Message-generating apparatus for use in connection with a compartment having an access opening and a closure for the opening, comprising:

means for detecting when said closure is moved toward a position allowing access to the compartment and producing a signal upon such occurrence;

means for inputting a predetermined time interval;

a clock adapted to product an enabling signal when the time of day is within the predetermined time interval;

means for receiving the detection signal and the enabling signal, determining simultaneous occurrence thereof, and generating a reminder signal in response thereto; and means for producing a voice-like audible message in response to the reminder signal, wherein the compartment comprises a refrigerator.

2. A message-generating apparatus for use in connection with a compartment having an access opening and a closure for the opening, comprising:

means for detecting when said closure is moved toward a position allowing access to the compartment and producing a signal upon such occurrence;

a clock for continuously producing time-of-day signals;

a digital memory for storing a predetermined daily time interval;

means for continuously comparing the time-of-day signal and the predetermined daily time interval to determine if the time-of-day falls within the predetermined interval, an enabling signal being produced in response to said falling within condition;

means for receiving the detection signal and the enabling signal, determining simultaneously occurrence thereof, and generating a reminder signal in response thereto; and means for producing a voice-like audible message in response to the reminder signal.

3. The apparatus of claim 2 wherein the receiving, determining, and generating means comprises a microprocessor.

4. The apparatus of claim 2 wherein the compartment comprises a refrigerator.

* * * * *